US009267317B2

(12) United States Patent
Vu

(10) Patent No.: US 9,267,317 B2
(45) Date of Patent: Feb. 23, 2016

(54) DOOR STOP ASSEMBLY

(75) Inventor: Dac V. Vu, Tustin, CA (US)

(73) Assignee: Dac V. Vu, Tustin, CA (US)

( * ) Notice: Subject to any disclaimer, the term of this patent is extended or adjusted under 35 U.S.C. 154(b) by 291 days.

(21) Appl. No.: 13/436,429

(22) Filed: Mar. 30, 2012

(65) Prior Publication Data

US 2013/0255033 A1 Oct. 3, 2013

(51) Int. Cl.
*E05F 5/06* (2006.01)
*E05F 5/08* (2006.01)

(52) U.S. Cl.
CPC ... *E05F 5/06* (2013.01); *E05F 5/08* (2013.01); *E05Y 2201/218* (2013.01); *E05Y 2201/46* (2013.01); *Y10T 16/61* (2015.01)

(58) Field of Classification Search
USPC ..... 411/389, 387.1–387.8, 401, 409; 16/82
See application file for complete search history.

(56) References Cited

U.S. PATENT DOCUMENTS

| | | | | |
|---|---|---|---|---|
| 947,865 | A | 2/1910 | Taubert | |
| 1,042,340 | A | 10/1912 | Gustafsson | |
| 1,198,227 | A | 9/1916 | Hinchey | |
| 2,496,691 | A | 2/1950 | Berry | |
| 2,521,885 | A | 9/1950 | Vasquez | |
| 2,798,404 | A * | 7/1957 | Schaefer et al. | 411/409 |
| 2,815,236 | A | 12/1957 | Lowinski | |
| 3,025,559 | A * | 3/1962 | Basinger | 16/85 |
| 3,100,664 | A | 8/1963 | Duval | |
| 3,163,453 | A | 12/1964 | Stephens | |
| 3,244,443 | A | 4/1966 | Rodgers | |
| 3,258,285 | A | 6/1966 | Smith | |
| 3,276,804 | A | 10/1966 | Heppner | |
| 3,300,239 | A * | 1/1967 | Dinkin | 292/251.5 |
| 3,701,557 | A | 10/1972 | Centofante | |
| 3,711,138 | A * | 1/1973 | Davis | 403/408.1 |
| 3,734,553 | A | 5/1973 | Sugasawara | |
| 3,934,909 | A | 1/1976 | Van Natter | |
| 3,969,786 | A | 7/1976 | Peak | |
| 3,976,316 | A | 8/1976 | Laby | |
| 3,994,043 | A | 11/1976 | Gurzenda | |
| 3,998,481 | A | 12/1976 | Anthone | |
| 4,026,588 | A | 5/1977 | Bisbing et al. | |
| 4,044,424 | A | 8/1977 | Sasgen | |
| 4,062,577 | A | 12/1977 | Butterfield et al. | |
| 4,084,290 | A | 4/1978 | Lymar et al. | |
| 4,099,755 | A | 7/1978 | Anderson | |
| 4,099,757 | A | 7/1978 | Palmer et al. | |
| 4,124,184 | A | 11/1978 | Juergens | |
| 4,134,608 | A | 1/1979 | Pool | |
| 4,141,104 | A | 2/1979 | Watson | |
| 4,159,837 | A | 7/1979 | Morita | |
| RE30,263 | E | 4/1980 | Horvath | |
| 4,209,150 | A | 6/1980 | Stephenson | |
| 4,218,807 | A * | 8/1980 | Snow | 16/86 A |
| 4,270,781 | A | 6/1981 | Nishimura | |
| 4,302,864 | A | 12/1981 | Morita | |

(Continued)

*Primary Examiner* — Emily Morgan
(74) *Attorney, Agent, or Firm* — Klein, O'Neill & Singh, LLP

(57) ABSTRACT

Door stops are generally discussed herein for stopping door knobs or other door hardware from slamming against a wall with particular discussions on door stops having dampening means. Aspects of the door stop assemblies discussed herein include the use of a helical coil spring spacer for delimiting movement of a door and either a pliable insert or an outer sheath or both for dampening the spring when the same is impacted. A combination magnet and magnetically attractable plate or two magnets with opposite magnetic poles may be used to temporary secure a door in a fixed position.

13 Claims, 15 Drawing Sheets

SECTION A-A

(56) References Cited

U.S. PATENT DOCUMENTS

| | | | | | |
|---|---|---|---|---|---|
| 4,322,103 | A | | 3/1982 | Acton | |
| 4,335,911 | A | | 6/1982 | Taylor | |
| 4,430,035 | A | * | 2/1984 | Rodseth | 411/402 |
| 4,434,524 | A | | 3/1984 | Gilchrist | |
| 4,502,246 | A | | 3/1985 | Minami | |
| 4,505,502 | A | | 3/1985 | Tomita | |
| 4,506,407 | A | | 3/1985 | Downey | |
| 4,532,672 | A | | 8/1985 | Anderson | |
| 4,609,216 | A | | 9/1986 | Baker et al. | |
| 4,669,766 | A | | 6/1987 | Hanchett, Jr. et al. | |
| 4,670,939 | A | | 6/1987 | Fisher | |
| 4,700,436 | A | | 10/1987 | Morita | |
| 4,702,506 | A | | 10/1987 | Iimura | |
| 4,782,553 | A | | 11/1988 | Morrison | |
| 4,784,554 | A | * | 11/1988 | Break | 411/383 |
| 4,852,919 | A | | 8/1989 | Nimee et al. | |
| 4,867,493 | A | | 9/1989 | Ward | |
| 4,982,984 | A | | 1/1991 | Yokota et al. | |
| 4,995,655 | A | * | 2/1991 | Freeman | 292/251.5 |
| 5,010,622 | A | | 4/1991 | Morita | |
| 5,046,544 | A | | 9/1991 | Coluccio | |
| 5,072,973 | A | | 12/1991 | Gudgel et al. | |
| 5,082,317 | A | | 1/1992 | Delaney, Jr. | |
| 5,161,282 | A | | 11/1992 | Pechota, Jr. | |
| 5,188,403 | A | | 2/1993 | Anderson | |
| 5,190,325 | A | | 3/1993 | Doss-Desouza | |
| 5,331,719 | A | | 7/1994 | Hum et al. | |
| 5,369,840 | A | | 12/1994 | Salvador et al. | |
| 5,575,514 | A | | 11/1996 | Troy | |
| 5,592,780 | A | | 1/1997 | Checkovich | |
| 5,713,623 | A | | 2/1998 | Mattingly | |
| 5,836,049 | A | | 11/1998 | Chiang | |
| 5,887,917 | A | | 3/1999 | Luciana | |
| 5,926,671 | A | | 7/1999 | Leibman | |
| 5,944,368 | A | | 8/1999 | Hastings | |
| 5,988,711 | A | | 11/1999 | Toma | |
| 6,016,588 | A | | 1/2000 | Kamerschen | |
| 6,149,212 | A | | 11/2000 | Kuntz et al. | |
| 6,151,754 | A | | 11/2000 | Chen | |
| 6,192,552 | B1 | | 2/2001 | Murphy | |
| 6,295,697 | B1 | * | 10/2001 | Simon | 16/86 R |
| 6,296,093 | B1 | | 10/2001 | Norris et al. | |
| 6,321,411 | B1 | | 11/2001 | Ikejiri et al. | |
| 6,430,775 | B1 | | 8/2002 | Bushey | |
| 6,467,125 | B1 | | 10/2002 | Johnson | |
| 6,477,749 | B1 | | 11/2002 | Reiter | |
| 6,568,720 | B1 | | 5/2003 | Szablewski | |
| 6,588,811 | B1 | | 7/2003 | Ferguson | |
| 6,607,223 | B1 | | 8/2003 | Mastro | |
| 6,651,295 | B2 | | 11/2003 | Hodson | |
| 6,658,697 | B2 | | 12/2003 | Liao | |
| D487,395 | S | | 3/2004 | Wockenfuss | |
| 6,789,293 | B2 | | 9/2004 | Habegger et al. | |
| 6,904,643 | B2 | | 6/2005 | Duffy | |
| 6,981,295 | B2 | | 1/2006 | Duffy | |
| 7,017,229 | B2 | | 3/2006 | Walcome | |
| 7,024,726 | B1 | | 4/2006 | Cornell | |
| 7,168,130 | B2 | * | 1/2007 | Shin | 16/82 |
| 2002/0003327 | A1 | | 1/2002 | Enoki et al. | |
| 2002/0090278 | A1 | * | 7/2002 | Lai | 411/387.8 |
| 2003/0056328 | A1 | | 3/2003 | Habegger et al. | |
| 2003/0062230 | A1 | | 4/2003 | Maeno et al. | |
| 2003/0178157 | A1 | | 9/2003 | David | |
| 2003/0234476 | A1 | | 12/2003 | Enoki et al. | |
| 2004/0045128 | A1 | * | 3/2004 | Frushour | 16/82 |
| 2004/0104584 | A1 | | 6/2004 | Ferguson | |
| 2004/0145193 | A1 | | 7/2004 | Walcome | |
| 2004/0168284 | A1 | | 9/2004 | Duffy | |
| 2005/0002755 | A1 | * | 1/2005 | Palm | 411/387.1 |
| 2005/0072535 | A1 | | 4/2005 | David | |
| 2005/0082841 | A1 | | 4/2005 | Amy | |
| 2005/0155179 | A1 | | 7/2005 | Duffy | |
| 2005/0229358 | A1 | | 10/2005 | Barone | |
| 2008/0109988 | A1 | * | 5/2008 | Jameson | 16/82 |

* cited by examiner

SECTION A-A

SECTION A-A

SECTION A-A

DOOR STOP ASSEMBLY

Door stops are generally discussed herein for stopping door knobs or other door hardware from slamming against a wall with particular discussions on door stops having dampening means and optionally magnetic means.

BACKGROUND

As is well known in the art, a door stop is a device mounted to a baseboard, a wall, or a door for stopping the door's hardware, such as a door knob, from slamming into and ruining the wall. The length of the door stop's spacer, measured from its base to its tip, is longer than the length of the door knob's projection from the surface of the door. In addition, its tip incorporates a blunt end having a surface area sized to generate less force when impacted by the door than the force generated by the door knob against the wall in the absence of the door stop.

Also well known in the art is the use of magnets to maintain doors in their fixed open positions. Typically a magnet, either mounted to a door or a wall, is used with a strike plate, mounted to the other one of the door or the wall, to generate a holding force. Once the magnet retrains the door in an open position, closing it will cause a loud spring resonance. Accordingly, there is a need for a magnetic door stop for maintaining a door in its fixed open position that has dampening capabilities to reduce spring vibration. There is also a need for a simple door stop with dampening capabilities.

SUMMARY OF THE PREFERRED EMBODIMENTS

The present system, apparatus, and method may be implemented by providing a door stop assembly for preventing door slams comprising: a spring spacer comprising three or more consecutively formed helical coils defining an interior space, a free end comprising a first diameter, and a fixed end comprising a larger second diameter; a flexible and pliable absorber for dampening the spring spacer, the absorber being in contact with and configured to constrain the three or more consecutive helical coils of the spring spacer to dampen the spring spacer along a portion of the spring spacer closer to the fixed end than the free end; and wherein the absorber comprises a proximal end comprising a proximal diameter and a distal end comprising a distal diameter, wherein the proximal diameter is larger than the distal diameter.

In yet other aspects of the present disclosure, there is provided a door stop assembly for preventing door slams comprising: a spring spacer comprising a plurality consecutively formed helical coils comprising a frusto-conical section; a flexible and pliable absorber having a frusto-conical section; and wherein the frusto-conical section of the absorber is in contact with and adapted to constrain at least a portion of the frusto-conical section of the spring spacer to dampen the spring spacer.

In still yet other aspects of the present system, apparatus, and method, there is provided a door stop assembly for preventing door slams comprising: a spring spacer comprising a fixed end, a free end, a middle section in between the fixed end and the free end, and a plurality of consecutively formed helical coils defining an interior space; a mounting bracket receiving a portion of the spring spacer at the fixed end of the spring spacer: a cap fitted over and in contact with a portion of the free end of the spring spacer; and a flexible and pliable absorber for dampening the spring spacer, the absorber being in contact with the spring spacer along a length of the spring spacer from its fixed end to its middle section.

Aspects of the present disclosure include a method for preventing door slams comprising: inserting a flexible and pliable absorber into a spring spacer comprising a plurality of helical coils comprising an inside surface defining an interior cavity, the flexible and pliable absorber filling and in contact with at least a portion of the interior cavity of the spring spacer: and stopping a door from slamming again a wall with the spring spacer.

The spring spacer may also be used with both an insertable absorber and an external absorber in a form of a sheath.

In yet other aspects of the present disclosure, a magnet and a strike plate or two magnets may be used with the spring spacer, which can temporary fix a pivotable door in a fixed position.

A still further feature of the present method, system, and assembly is a door stop assembly comprising a spacer body, a magnet located at a tip of the spacer body and an anchor screw at a base of the spacer body; and wherein the anchor screw comprises a first extended surface to prevent pitching and yawning and a second extended surface to prevent rolling of the anchor screw relative to the spacer body.

In a particular example, the anchor screw is singularly formed with the first extended surface and the second extended surface.

In another example, at least the first extended surface or the second extended surface is separately formed from a threaded shaft on the anchor screw.

In a still further example, a method for prevent door slam is provided comprising placing a strike plate against a permanent magnet or a ferromagnetic material located on a door stop spacer body; and placing double-sided adhesive tape against the strike plate.

In a particular example, the method can incorporate an anchor screw and the anchor screw is screwed into a base board or a door and the adhesive tape, in addition to being adhered to the strike plate, is adhered to the other one of the base board or the door.

In a still further example, the method can incorporate an anchor screw in the spacer body and wherein the anchor screw comprises a first extended surface to prevent pitching and yawning and a second extended surface to prevent rolling of the anchor screw relative to the spacer body.

Other aspects and features of the door stops provided herein may be better appreciated as the same become better understood with reference to the specification, claims, and appended drawings.

DETAILED DESCRIPTION

The detailed description set forth below in connection with the appended drawings is intended as a description of the presently preferred embodiments of door stops provided in accordance with aspects of the present disclosure and is not intended to represent the only forms in which the present method, apparatus, and system may be constructed or utilized. The description sets forth the features and the steps for constructing and using the door stops of the present disclosure in connection with the illustrated embodiments. It is to be understood, however, that the same or equivalent functions and structures may be accomplished by different embodiments that are also intended to be encompassed within the spirit and scope of the present system, apparatus, and method. Also, as denoted elsewhere herein, like element numbers are intended to indicate like or similar elements or features.

Figure 1:
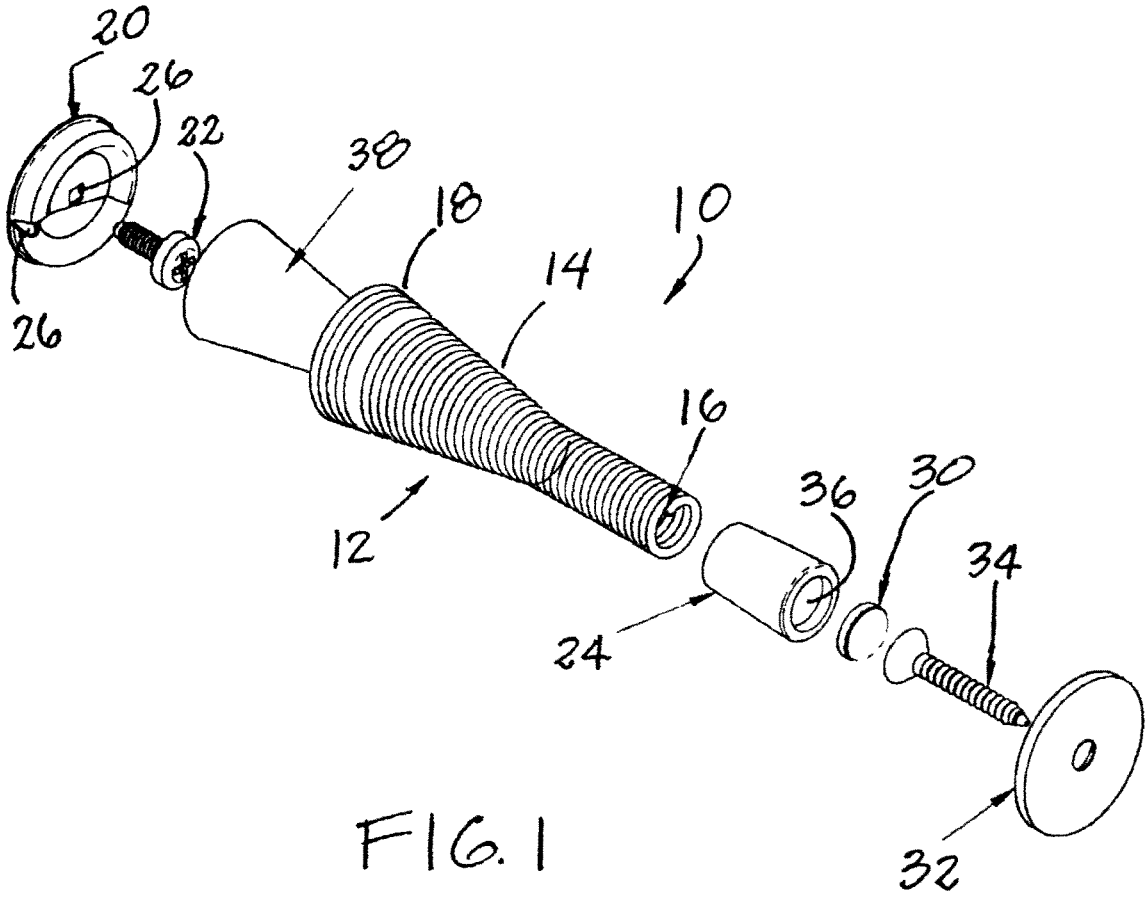
FIG. 1 is a semi-schematic perspective view of a door stop assembly provided in accordance with aspects of the present disclosure.

Referring now to FIG. 1, a semi-schematic exploded view of a door stop assembly provided in accordance with aspects of the present disclosure is shown, which is generally designated 10. In one exemplary embodiment, the door stop assembly 10 comprises a helical coil spring spacer 12 having a body 14 comprising a free end 16 and an attachment end 18 defining a length therebetween. The spring spacer 12 is well known in the art for use as a door stop device for a pivotable door. As is well known in the art, the length of the spring spacer 12 may vary depending on the particular door stop application, which generally depends on the hardware used, such as a door knob.

The door stop assembly 10 further comprises a mounting bracket 20, a mounting screw 22 for securing the mounting bracket 20 to a structure, such as a base board, and a cap 24 for capping the free end 16 of the spring spacer. The mounting bracket 20 typically incorporates a boss 26 for receiving the mounting screw 22 and a socket 26 for receiving a first loop or first helical coil of the spring spacer 12 to secure the spring spacer to the mounting bracket.

To generate a securing force to secure a door in an open position, a magnetic force may be used. In one exemplary embodiment, a combination magnet 30 and a magnetically attractable plate or strike plate 32 is incorporated. However, two magnets with opposite attractions may alternatively be used. As further discussed below, by mounting the magnet 30 to a spring spacer 12 and the strike plate 32 to a door (not shown), when the strike plate contacts the magnet, the magnetic force retains the strike plate to the magnet. Furthermore, because the strike plate is mounted to a door, the door is retained in the open position by the magnet. Alternatively, the spring spacer 12 may be mounted to a door and the strike plate to a fixed structure, such as a wall or a base board, without deviating from the spirit and scope of the present system, apparatus, and method.

In one exemplary embodiment, a plate screw 34 is used to secure the strike plate 32 to a door and a receiving bore 36 is incorporated in the cap 24 to receive the magnet 30, using interference fit. Optionally, adhesive or a bonding agent may be used to more permanently secure the magnet to the cap. As is readily apparent to a person of ordinary skill in the art, a reverse mounting configuration wherein the magnet is mounted to a door and the strike plate is secured to the fixed structure may be employed without deviating from the spirit and scope of the present system, apparatus and method.

To dampen the spring spacer 12 when it deflects as a result of closing a door, as further discussed below, a flexible absorber 38 is used to absorb the vibration. In one exemplary embodiment, the flexible absorber 38 is a pliable insert configured to be inserted into the interior cavity of the spring spacer 12 (See also FIGS. 3 and 6). The flexible absorber is configured to reduce the magnitude of deflection and shorten the decay time of the amplitude displacement of the spring spacer when the same is impacted and vibrates. Usable materials for making a flexible absorber as provided in accordance with aspects of the present disclosure include sponge material, an elastomer foam, LDPE (low density polyethylene) foam, PVC foam, foam rubber, and cross-linked, closed-cell polyolefin foam. However, other thermoplastic elastomers not mentioned herein may be also used provided they are capable of cooperating with the spring spacer to produce a shorter decay time than without the insert. A characteristic of a preferred flexible absorber is pliability, or ability to rebound or return to or near its original shape.

Figure 2:
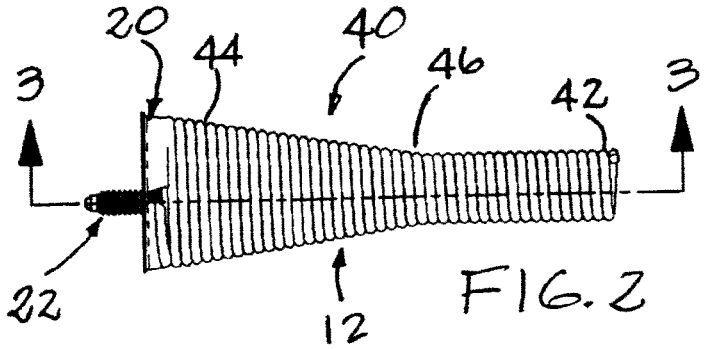
FIG. 2 is a semi-schematic side view of a spacer unit provided in accordance with aspects of the present disclosure, which includes a mounting plate, a mounting screw, a spring spacer, and a pliable insert.
Figure 3:
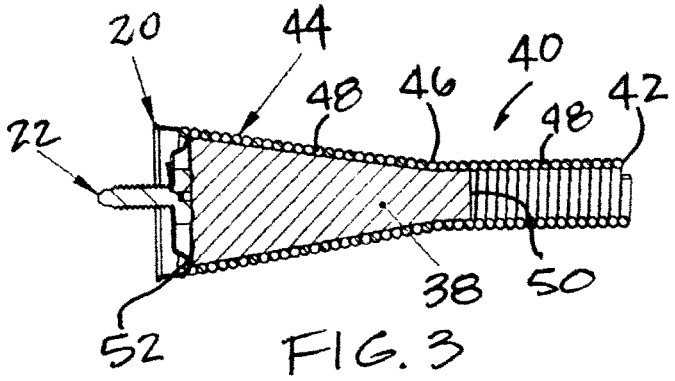
FIG. 3 is a semi-schematic cross-section side view of the spacer unit of FIG. 2 taken along line 3-3.

FIG. 2 is a semi-schematic side view of the spring body 12 attached to the mounting bracket 20 and the mounting screw 22 passing therethrough, which are collectively herein referred to as a spacer unit 40. The spacer unit 40 also includes the flexible insert 38 disposed internally of the spring spacer 12 (FIG. 3). In one exemplary embodiment, the spacer unit 40 may be secured to a fixed or non-moving structure, such as a wall or a base board. However, in certain applications, the spacer unit 40 may be secured to a movable structure, such as a door.

In one exemplary embodiment, the spring spacer 12 comprises a generally cylindrical distal portion 42 and a frusto-conical proximal portion 44 defining a transition zone 46 therebetween. However, a uniform cylinder throughout the length of the spacer or a frusto-conical shape spring spacer extending from the fixed end 18 to the free end 16 without a transition zone may be incorporated without deviating from the spirit and scope of the present disclosure.

FIG. 3 is a cross-sectional side view of the spacer unit 40 of FIG. 2 taken along line 3-3. The flexible insert 38 is shown stuffed into the internal space defined by the plurality of helical coils 48 of the spring spacer 12. In accordance with one aspect of the present method, system, and apparatus, the flexible insert 38 is fabricated with the same shape as the spring spacer 38 and is slightly enlarged so as to produce a compression or interference fit when placed internally of the spring spacer. The interference is such that a slight or low resistance is produced upon inserting the pliable insert 38 into the internal space without undue demand or force. Said differently, the pliable insert 38 should substantially fill the internal space defined by the proximal portion 44 of the spring body. In a preferred embodiment, the pliable inset 38 should also fill a section of the distal portion 42 of the spring body near the transition zone 46. In a less preferred embodiment, a small space or gap exists between the insert and the spring spacer.

The pliable insert 38 comprises a length defined between the distally facing wall surface 50 and the proximally facing wall surface 52. In one exemplary embodiment, the length of the pliable insert 38 is sufficiently long such that upon inserting the first helical coil 48 of the fixed end of the spring spacer 12 into the mounting plate 20, a compression force is generated by the mounting plate 20 against the distally facing wall surface 52 of the pliable insert 38. However, a nominal gap or a surface contact between the mounting plate 20 and the proximally facing wall surface may be incorporated without deviating from the spirit and scope of the present disclosure.

Thus, in accordance with aspects of the present disclosure, three or more consecutive coils 48 of a helical coil spring is restrained by a flexible absorber for reducing the decay time of the spring displacement of the spring spacer when the same is impacted and vibrates. As further discussed below with reference to FIGS. 7-9, the restraining force may be acted internally of the spring spacer or externally. By restraining, the absorber limits, prevents, or decreases the vibration and reduces the decay time of the spring spacer a measurable amount than if no absorber was used. Preferably, the dampening effect is produced by physical contact between the spring spacer and a flexible and pliable absorber, which can be internally or externally of the spring spacer or both.

Figure 4:
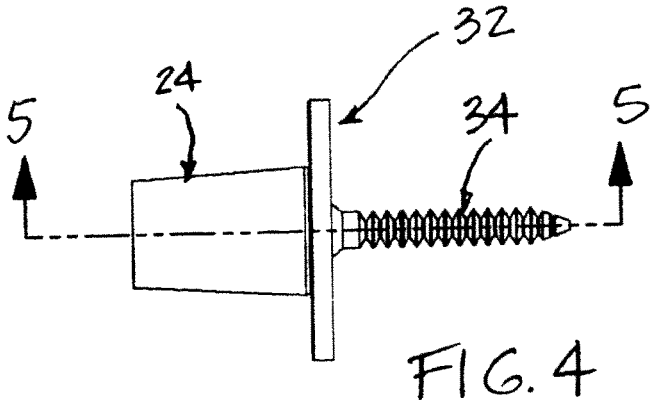
FIG. 4 is a semi-schematic side view of a cap having a magnet disposed therein attracted to a strike plate having a plate screw passing therethrough.

FIG. 4 is a semi-schematic side view showing a cap 24 in contact with a strike plate 32, which has a plate screw 34 passing therethrough. FIG. 4 is a depiction of an engaged position between a magnet (FIG. 5, 30) and the strike plate 32, shown without the other door stop components for clarity.

Figure 5:
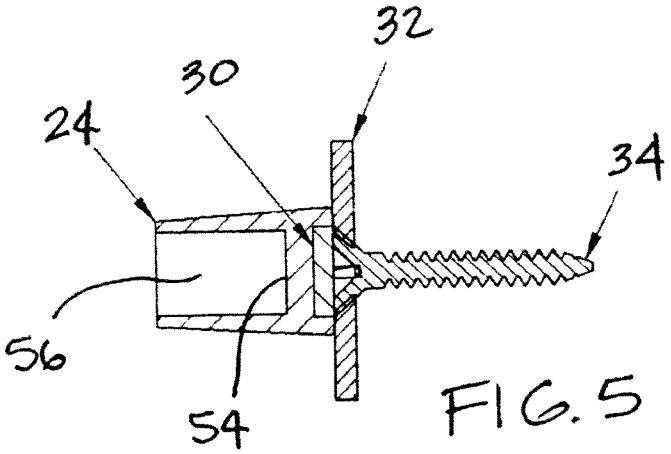
FIG. 5 is a semi-schematic cross-sectional side view of the components of FIG. 4 taken along line 5-5.

FIG. 5 is a cross-sectional side view of the components of FIG. 4, taken along line 5-5. In one exemplary embodiment, the cap 24 incorporates an internal web 54, which separates the internal cavity of the cap 24 into a spring spacer receiving chamber 56 and a magnetic receiving chamber 58. As discussed previously, the magnetic receiving chamber 58 is configured to receive a magnet 30 and the spring spacer receiving chamber 56 is configured to receive the free end 16 of the spring spacer 12. The cap 24 may be molded from thermoplastic material, a thermoplastic elastomer material, or a rubber material.

Figure 6:
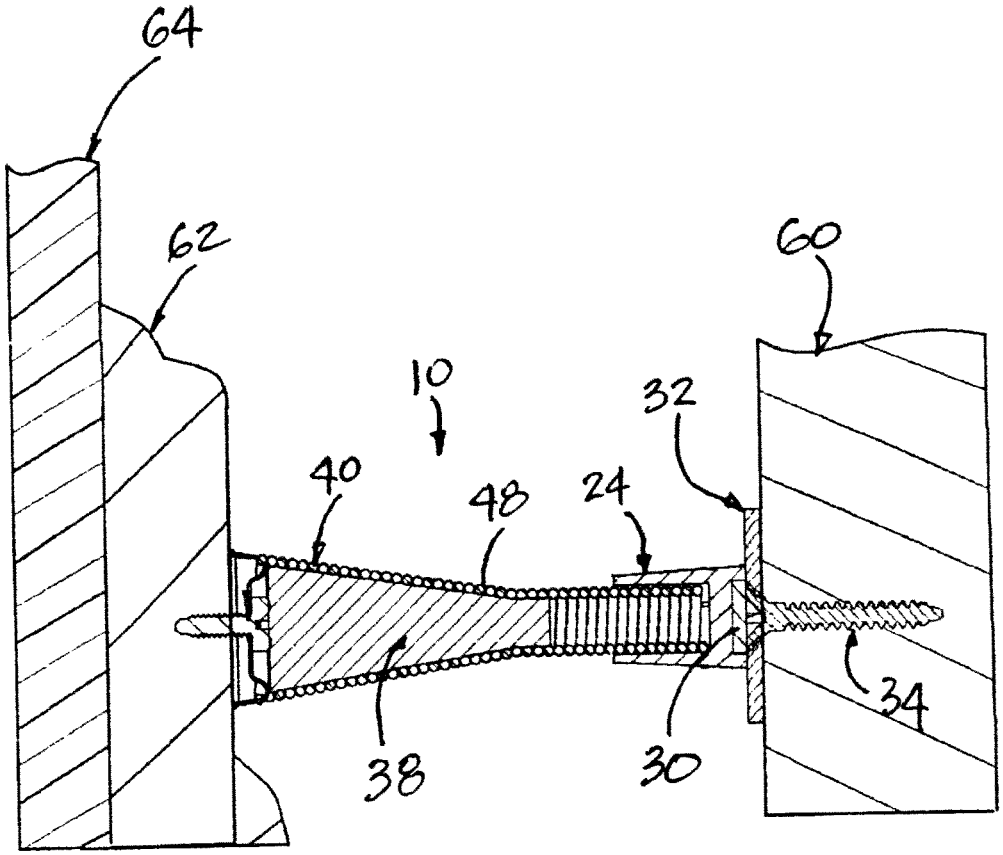
FIG. 6 is a cross-sectional side view of the door stop assembly of FIG. 1 mounted to a door and a base board.

FIG. 6 is a semi-schematic cross-sectional side view of a door stop assembly 10 as provided in accordance with aspects of the present disclosure mounted to a door 60 and a baseboard 62, which is connected to a wall 64. More specifically, the strike plate 32 is mounted to the door and the spacer unit 40 is mounted to the baseboard 62. The combination cap 24 and magnet 30 is positioned over the spring spacer 12. The door stop assembly 10 should be aligned so that as door swings to its fully opened position, the magnet 30 strikes the strike plate 32 and the magnetic force from the magnet 30 retains the two by magnetic attraction.

The strike plate 32 may be separated from the magnet 30 simply by swinging the door closed and moving the strike plate 32 away from the magnet 30. Because of the magnetic force, the separation causes the spring spacer 12 to deflect. However, because of the pliable insert 38 provided in accordance with aspects of the present disclosure, the sound generated and the vibration produced is minimized. Said differently, the vibrating helical coils are constrained by the pliable absorber.

Figure 7:
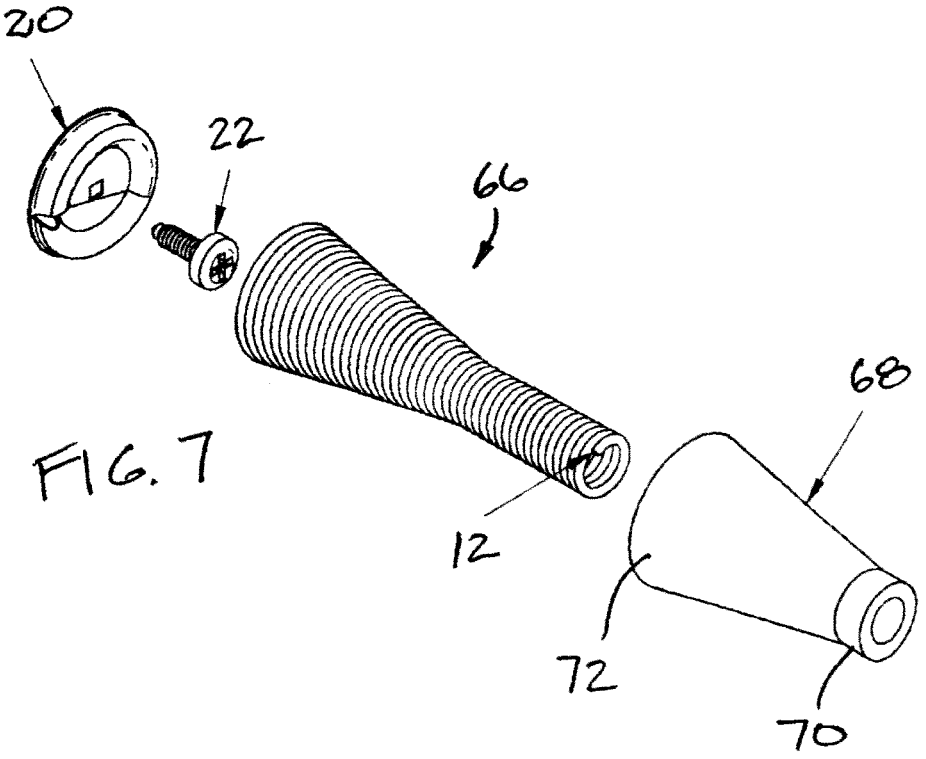
FIG. 7 is a semi-schematic perspective view of a spacer unit provided in accordance with aspects of the present disclosure, which includes a pliable sheath configured to fit over spring spacer.

FIG. 7 is a spacer unit 66 provided in accordance with yet another aspect of the present disclosure. In one exemplary embodiment, the spacer unit 66 comprises a spring spacer 12, a mounting bracket 20, and a mounting screw 22 for securing the mounting bracket to a structure, such as a baseboard, wall, or door. The spacer unit 66 also incorporates a flexible absorber for dampening the spring spacer. However, rather than a pliable insert, the present embodiment utilizes a pliable sleeve or sheath 68 as a dampening absorber in the form of an overcoat. In one exemplary embodiment, the pliable sheath incorporates a distal portion 70 and a proximal portion 72 that correspond to the contour of the distal and proximal portions of the spring spacer 12. More preferably, the sheath 68 is sized such that it fits over the spring spacer 12 in a stretched fit, i.e., interference fit.

In one exemplary embodiment, the pliable sheath 68 is made from a pliable elastomer. More preferably, the sheath 68 is made from a thermoplastic elastomer (TPE) and is both resilient and pliable. Optionally, the sheath may be textured, colored, or transparent to provide an aesthetic appeal. For example, the sheath may have the same color as the wall color, as the baseboard color, or a distinct color to draw attention to the door stop, either for aesthetic or other reasons. Thus, in accordance with aspects of the present method, system, and apparatus, any color among the spectrum of colors may be incorporated for the color of the sheath.

Figure 8:
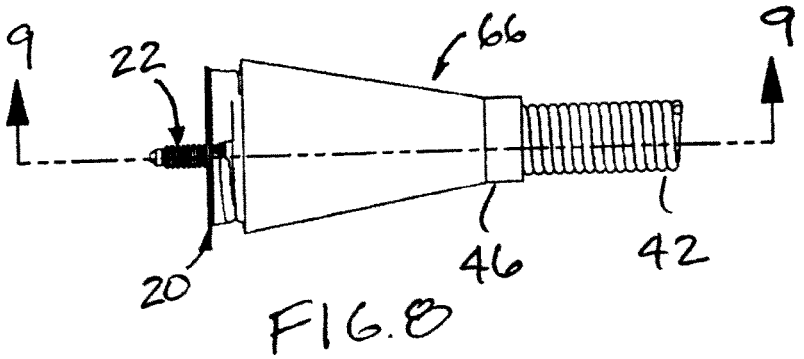
FIG. 8 is a semi-schematic side view of the spacer unit of FIG. 7 in an assembled state.

FIG. 8 is a semi-schematic side view of the spacer unit 66 provided in accordance with aspects of the present invention. The spacer unit 66 is shown without a cap, a magnet, and without the strike plate. In one exemplary embodiment, the sheath 68 surrounds the entire proximal portion 44 (See, e.g., FIG. 2) of the spring spacer 12 and a portion of the distal portion 42 near the transition zone 46. In an alternative embodiment, the sheath 68 can extend the entire distal portion 42 of the spring spacer 12 or any amount or length therebetween. In one aspect of the present disclosure, the sheath 68 is formed with internal ribs or bumps (not shown) to facilitate engagement with the exterior surface of the spring spacer 12. This prevents or at least inhibits the sheath from sliding towards the free end of the spring spacer 12. In yet another alternative embodiment, the proximal end edge of the sheath 68 comprises a reduced collar (not shown). The reduced collar is adapted to wedge in between two adjacent helical coils, which prevents the sheath from sliding relative to the spring spacer.

Figure 9:
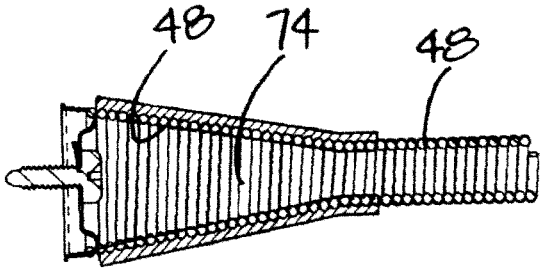
FIG. 9 is a semi-schematic cross-sectional side view of the spacer unit of FIG. 8 taken along line 9-9.

FIG. 9 is a semi-schematic cross-sectional side view of the spacer unit 66 of FIG. 8 taken along line 9-9. As shown, the interior space 74 defined by the plurality of helical coils 48 is empty or hollow. The dampening is provided by the sheath acting on three or more of the helical coils 48 along an external surface of the spring spacer. The spacer unit 66 may be used in the same manner as the spacer unit 40 shown with reference to FIG. 6, i.e., with a cap, magnet, and strike plate.

Figure 10:
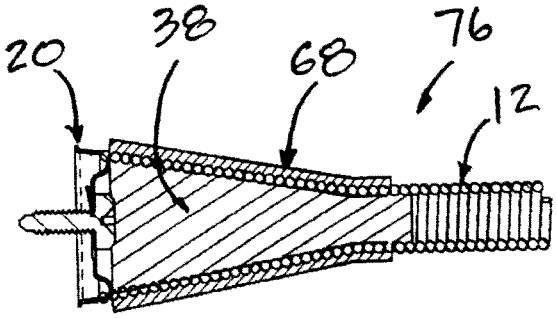
FIG. 10 is a cross-sectional side view of yet another alternative spacer unit provided in accordance with aspects of the present disclosure.

FIG. 10 is a semi-schematic cross-sectional side view of yet another alternative spacer unit 76 provided in accordance with aspects of the present disclosure. In the alternative embodiment, an insertable absorber 38, such as the one shown in FIG. 3, may be used in combination with a sheath 68 to provide added dampening. Still alternatively, the spacer unit 76, with or without an insertable absorber 38, may be used with a cap 24 (FIG. 1) but without a magnet or a strike plate. Yet still alternatively, the spacer unit 76 may be used in the same manner as the spacer unit 40 shown with reference to FIG. 6, i.e., with a cap, magnet, and strike plate.

Figure 11:
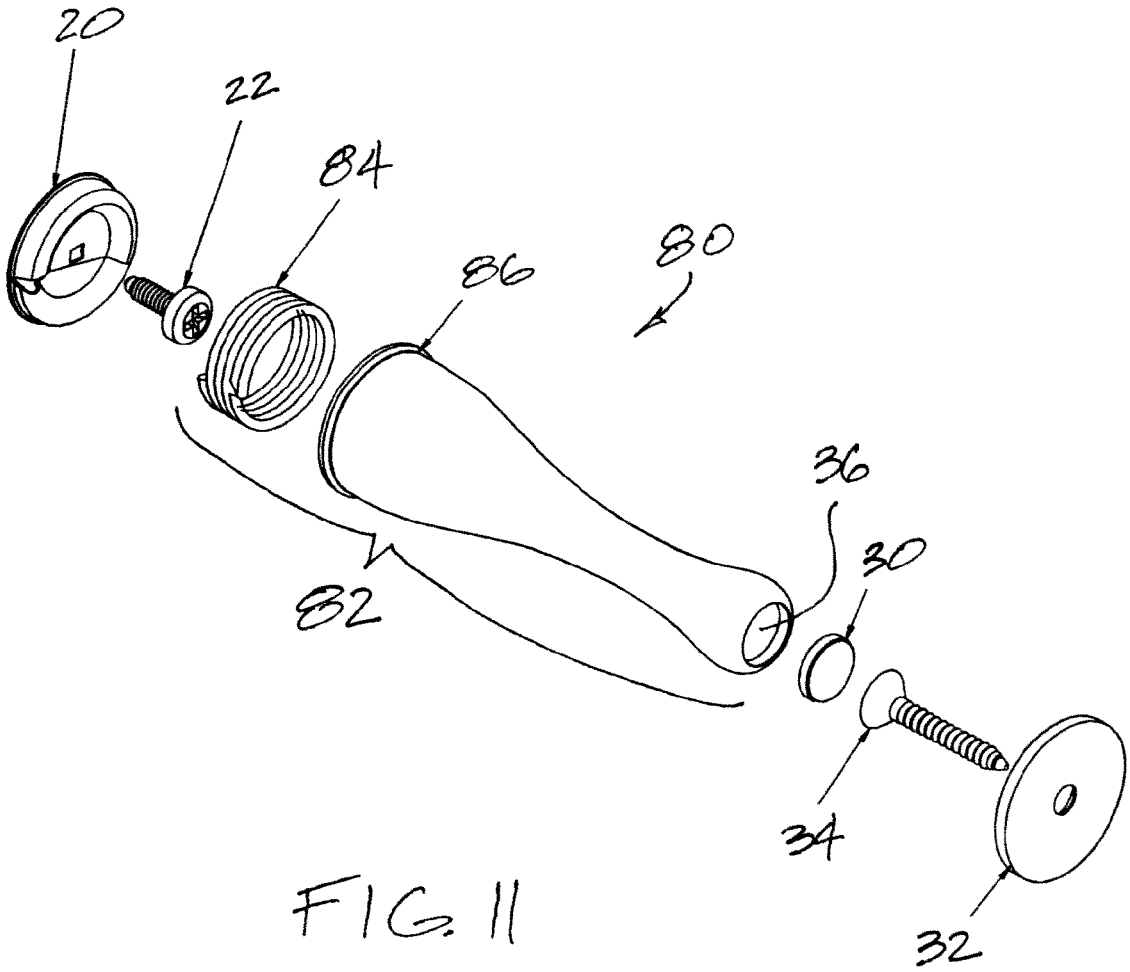
FIG. 11 is a perspective exploded view of still yet another alternative door stop assembly provided in accordance with aspects of the present disclosure.

FIG. 11 is a perspective exploded view of yet another door stop assembly 80 provided in accordance with aspects of the present disclosure. The present door stop assembly, like the other door stop assemblies discussed elsewhere herein, includes a mounting bracket 20, a mounting screw 22, a magnet 30, a plate screw 34, and a strike plate 32. However, in the present embodiment, the spacer function for preventing a door knob or handle from slamming against a structure or a wall and the vibration absorbing function are integrated into a combination molded spacer coil 82, which comprises a helical coil section 84 and a spacer 86. Broadly speaking, the combination molded spacer coil 82 may be used to replace the spring spacer 12, cap 24, and either a sleeve or an insert in the other disclosed door stop embodiments.

Figure 12:
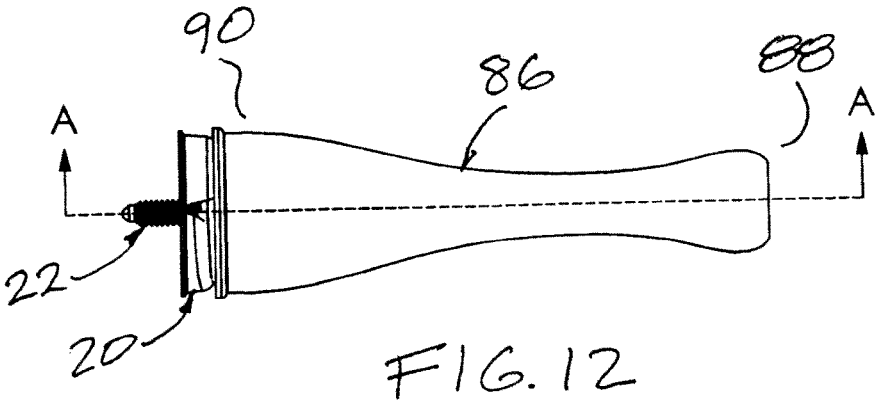
FIG. 12 is a side view of a spacer unit of the door stop assembly of FIG. 11.
Figure 13:
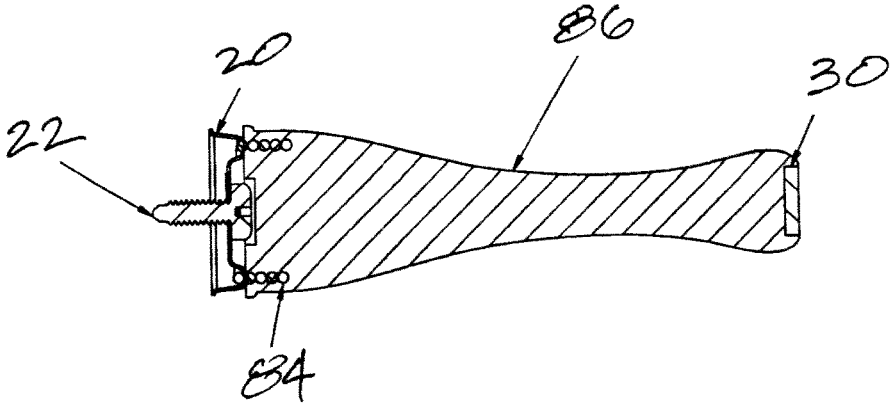
FIG. 13 is a cross-section side view of the spacer unit of FIG. 12 taken along line A-A.

With reference to FIGS. 12 and 13 in addition to FIG. 11, in one embodiment, the spacer 86 is made from a rubber material and is over-molded to several of the coils of the helical coil section 84, such as 2-8 coils or more, with one or two coils of fractions thereof left exposed to enable engagement with the mounting bracket 20. Thus, the helical coil section 84 is relatively short and in one embodiment is short on the order of less than the length of the mounting screw 22 or the length of the plate screw 34.

The rubber may be made from a number of prior art rubber materials, such as acrylonitrile-butadiene rubber (NBR), hydrogenated acrylonitrile-butadiene rubber (HNBR), ethylene propylene diene rubber (EPDM), fluorocarbon rubber (FKM), chloroprene rubber (CR), silicone rubber (VMQ), fluorosilicone rubber (FVMQ), polyacrylate rubber (ACM), ethylene acrylic rubber (AEM), styrene-butadiene rubber (SBR), polyester urethane/polyether urethane (AU/EU), natural rubber, and polyurethane (PUR), as non-limiting examples. The rubber materials may individually be referred to as an elastomer or collectively as a class of elastomers. More preferably are rubber or elastomer materials that exhibit good resiliency, good tear strength resistance, heat aging resistance, and low price per unit. Materials of preferred characteristics include NBR, EPDM, CR, SBR, and NR.

Referring again to FIG. 11, the spacer 86 may be molded with a singularly formed receiving bore 36 for receiving a magnet 30. In one embodiment, the magnet 30 is co-molded with the spacer. In another embodiment, the magnet 30 is manually inserted into the receiving bore 36 following formation of the spacer. If the magnet 30 is subsequently inserted, glue, adhesive, and the like is used to more permanently secure the magnet to the spacer. The spacer is preferably solid in construction except for the distal end 88 in which a bore is provided and the proximal end 90 in which a cavity is formed as a bi-product of co-molding with the helical coil section 84. In an alternative embodiment, the distal end 36 is configured to receive a metal plate for attracting a magnet positioned where the strike plate 32 is shown in FIG. 11.

In one embodiment, the spacer 86 is molded to embody a shape of a bowling pin. In another embodiment, the spacer has a shape of a baseball bat. In another embodiment, the spacer has a shape of a tennis racquet. More broadly speaking, because the spacer is molded from a rubber material, it can embody a number of shapes and sizes limited only by one's imagination. In one particular embodiment, the rubber is colored with colors other than black or may embody a combination of colors, such as a candy cane. Although the proximal end 90 of the spacer is generally wider in cross-section than the distal end 88, as shown in FIG. 13, in other embodiments, such as for a tennis racket, the distal end can be wider than the proximal end.

Figure 14:
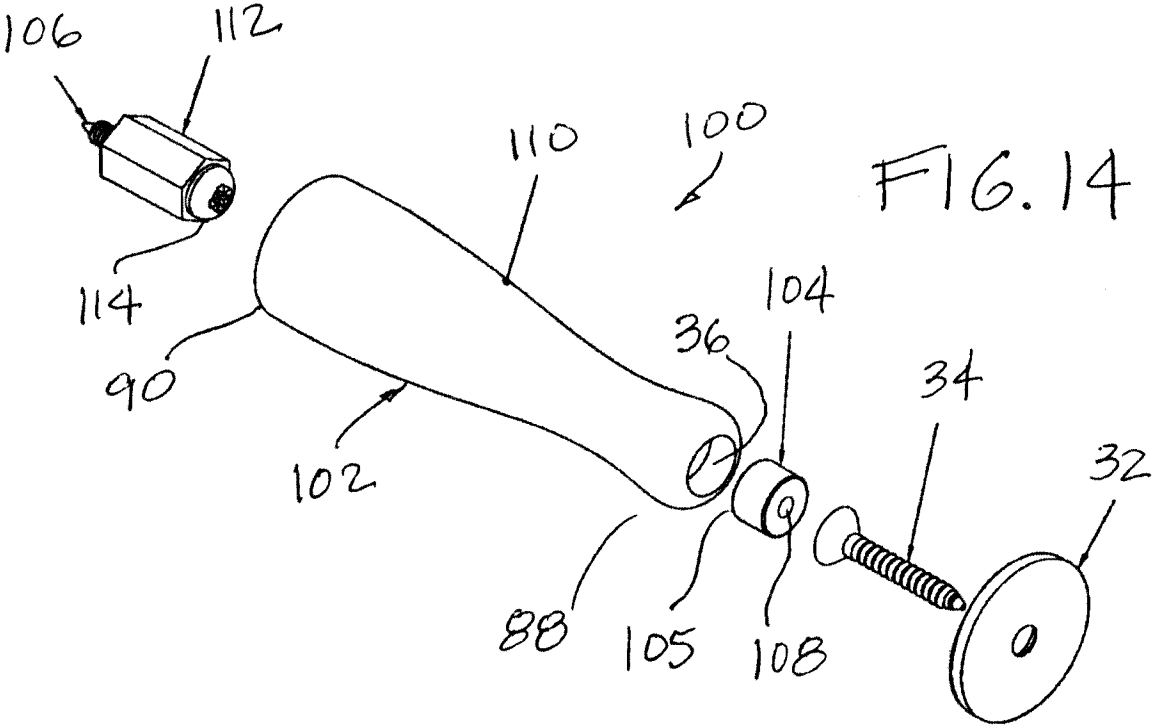
FIGS. 14-17 show various views another door stop assembly provided in accordance yet with another aspect of the present disclosure.

FIG. 14 is an exploded perspective view of still yet another door stop assembly provided in accordance with a further aspect of the present disclosure, which is generally designated 100. As shown, the door stop assembly 100 comprises a spacer 102 comprising a receiving bore 36 for accommodating a magnet 104 and an anchor screw 106 located at the proximal end 90. In one embodiment, the magnet 104 is generally cylindrical and comprises a bore 108, which may or may not extend all the way through the entire length of the magnet. In an embodiment, the bore 108 extends all the way through. The bore 108 is preferably centrally located on the magnet to facilitate centering the magnet relative to the receiving bore 36 and/or to the centerline of the spacer body 110. In alternative embodiments, the magnet may have a square shape, a triangle shape, a rectangular shape, a diamond shape, or an oval shape. However, other shaped magnets may be incorporated without deviating from the spirit and scope of the present method, system, and assembly, such as a polygon shape. The magnet 104 may be secured to the bore 108 using adhesive. In another embodiment, the magnet 104 is co-molded and secured to the bore using interference or overlapping. In one embodiment, the spacer body 110 is over-molded to the magnet. To provide for a more secured grip, the magnet 104 is provided with an enlarged base (not shown) near its proximal end 105 or somewhere just proximal of the top surface 130 so that the over-molded spacer body physically engages the magnet. The enlarged base may be fabricated, molded, or extruded with the magnet or may be glued to the magnet. Alternatively, a groove instead of an enlarged base may be incorporated for engaging with the mold material. In other embodiments, magnet 104 sits flushed or is recessed from the distal end of the spacer body. In yet other embodiment, the magnet does not have a bore 108 and is gripped from the outside during molding.

In one embodiment, the anchor screw 106 comprises a nut 112 having an enlarged body with a threaded bore for mechanical engagement with a mounting screw 114. The anchor screw 106 is configured to be embedded into the spacer body 110, such as by co-molding or over-molding the spacer body 110 over the anchor screw or by gluing, to act as a means for fixing the spacer body 110 to a door or a stationary support structure, such as a wall or a baseboard. The mounting screw 114 is fixed relative to the nut 112, which is fixed relative to the spacer body 110. Thus, the spacer body 110 may be secured to a door or a stationary support structure by grabbing the spacer body, preferably near the proximal end 90, and rotating the spacer body while aligning the mounting screw 114 to a pre-drilled or pre-formed bore, such as a pilot hole. In an alternative embodiment, a self-tapping mounting screw 114 is used so that the anchor may be secured to a door or a support structure without having to first pre-form or pre-drill a bore. In yet another embodiment, a J-bolt or an eye-bolt is used as an anchor screw instead of a two-piece anchor screw as shown. In less preferred embodiments, the anchor screw is made from more than two pieces.

In one embodiment, the door stop assembly 100 is molded from an elastic plastic material, such as a thermo plastic elastomer (TPE). The magnet 104 and the anchor screw 106 are fixed relative to a mold and a TPE material is injected into the mold to form the spacer body 110. There are six generic classes of TPEs generally considered to exist commercially. They are styrenic block copolymers, polyolefin blends, elastomeric alloys (TPE-v or TPV), thetinoplastic polyurethanes, thermoplastic copolyester and thermoplastic polyamides. Examples of TPE products that come from block copolymers group are Styroflex (BASF), Kraton (Shell chemicals), Pellethane (Dow chemical), Pebax, Arnitel (DSM), Hytrel (Du Pont), and others. Known elastomer alloys include: Santoprene (Monsanto), Geolast (Monsanto), Sarlink (DSM), Forprene (So.F.Ter. SpA) and Alcryn (Du Pont). In alternative embodiments, the door stop assembly 100 is made from a vulcanized rubber material, similar to other embodiments described elsewhere herein. Certain thermoplastic materials may also be used to mold the spacer body, such as low density polyethylene (LDPE). In another embodiment, polyurethane having a Shore A hardness of 45 to 70 is used to form the spacer body 110. The spacer body should have a completed form or shape that is firm yet pliable or bendable.

Figure 15:
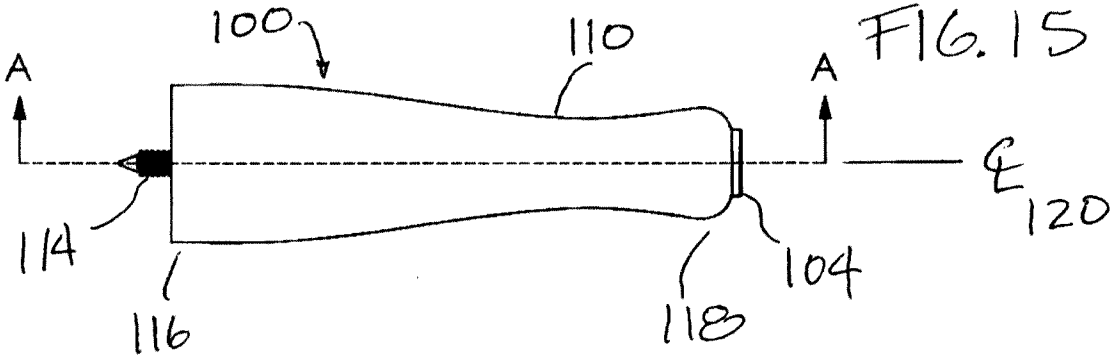
Figure 16:
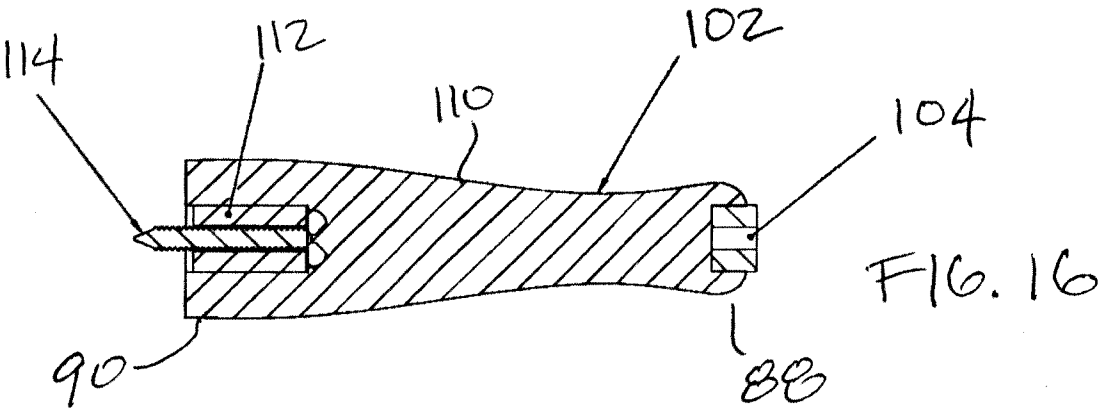

FIGS. 15 and 16 are side view and cross-sectional side view, respectively, of the door stop assembly 100 of FIG. 14. In the embodiment shown, the spacer body 110 comprises a base 116, a tip 118, and a centerline 120 extending between the base and the tip. Because the spacer body 100 is preferably made from a flexible material, such as from a TPE material, a rubber material, or a flexible thermoplastic material, it is naturally more elastic than a hard or rigid thermoplastic material. Thus, the spacer body 110 is configured to elastically deform along the lengthwise direction, either due to tensile or compressive force, or twist, such as by shearing, bending, or torsion, a greater amount for a given force than a comparable spacer made from a hard thermoplastic material. The greater relative elastic property allows the spacer body 100 to bend and deflect to engage and disengage the magnet 104 from a strike plate 32, as further discussed below. The contour of the spacer body, without a distinct sharp section along the length of the spacer body allows it to bend or flex over a larger range than a specific or specified neck section. In an alternative embodiment, a helical coil spring having a generally constant outside diameter is embedded inside the spacer body to provide added strength against compression or compressive force. The embedded spring may be placed centrally of the spacer body 100 so that it is generally aligned with the centerline 120. In yet another embodiment, the magnet 104 and the mounting screw 114 may incorporate posts or projections so that the embedded spring may couple to and/or align with the projections.

Figure 17:
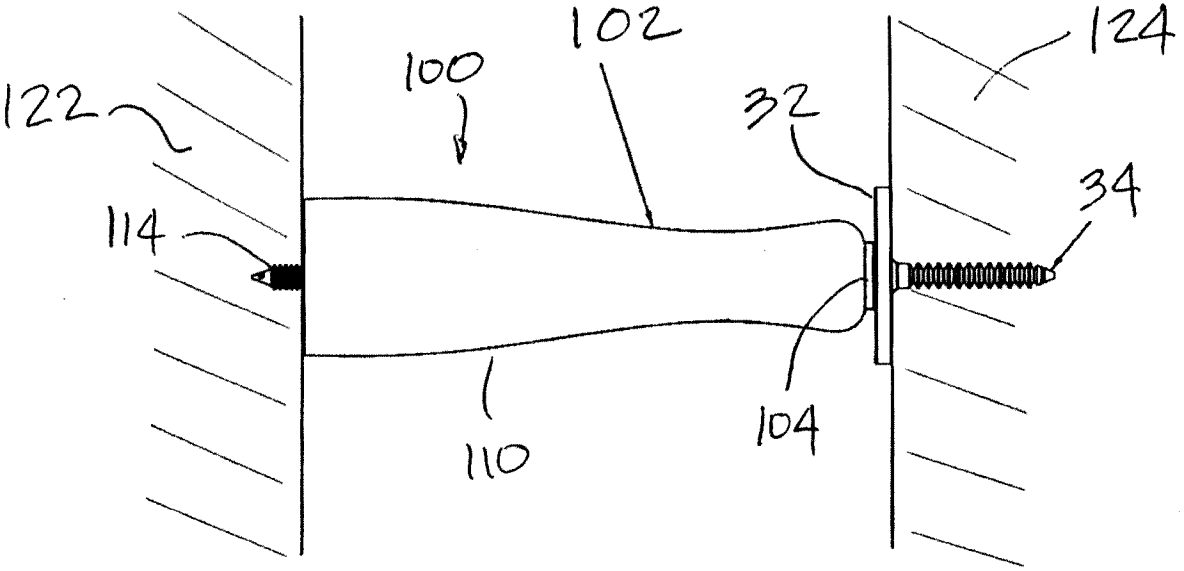

FIG. 17 is a partial side and cross-sectional view of the door stop assembly 100 mounted to a first wall structure 122 and strike plate 32 mounted to a second wall structure 124. In an embodiment, the first wall structure 122 is a wall surface or a base board and the second wall structure 124 is a door mounted on one or more hinges. In another embodiment, the first wall structure is a door and the second wall structure is a base board or a wall surface. The door stop assembly 100 is mounted first to the first wall structure 122. In one embodiment, the mounting screw 114 is threaded to an existing bored hole on the first wall structure. In other embodiments, a hole is pre-drilled before the mounting screw is attached. The door stop assembly 100 may be mounted by simply grabbing and rotating the spacer body 110 until the proximal end is generally flush with the surface of the first wall structure 122. In an embodiment, the size of the anchor screw is #6 wood screw and a ⅛" drill bit is used to pre-drill a hole. However, other sized anchor screws with different sized drill bits may be used without deviating from the spirit and scope of the present disclosure.

The strike plate 32 may be mounted by first rotating the second wall structure 124 until it comes close to or touches the distal tip of the spacer 102. The contact point or projected contact point on the second wall structure is then marked and drilled. The strike plate 32 is then secured to the second wall structure 124 using a plate screw 34.

Thus, an aspect of the present disclosure includes a method for guarding against door slams by rotating a spacer body made from a one piece resilient material, such as TPE, rubber, or flexible thermoplastic, having a cavity at a distal end and an anchor screw at a proximal end into a wall structure and providing a length such that a door knob on a door is prevented from slamming against a wall due to relative lengths between the spacer body and the door knob.

Another aspect of the present system and apparatus is a door stop configured to retain a door in an open state using magnetic force. In an embodiment, the door stop for retaining a door open with magnetic force comprises a bendable elastic spacer body molded from at least one of a rubber material, a thermo plastic elastomer, and a flexible plastic material over an anchor screw so that at least part of the anchor screw extends axially out a proximal end of the spacer body. The spacer body comprises a spacer body distal end comprising an opening and a bore defining a bounded cavity. In one embodiment, a permanent magnet or a ferromagnetic material is positioned in the cavity at the spacer body distal end such that at least part of the permanent magnet or the ferromagnetic material protrudes from the opening of the spacer body distal end. The spacer body further has a spacer body length that is sufficiently long for preventing a door handle of a door from slamming against a wall and an area of reduced cross section closer to the distal end than the proximal end. In a particular embodiment, the spacer body distal end has an outside diameter that is larger than an outside diameter of the permanent magnet or the ferromagnetic material positioned in the cavity of the spacer body. The present apparatus and system are also understood to include a door stop assembly comprising a magnet that is fixed axially relative to a spacer body, and an anchor screw that is fixed axially relative to the spacer body and to the magnet. The apparatus and system are further understood to include a singularly molded body having at least two different materials and a magnet, include a metallic anchor, a non-metallic spacer body, and a magnet.

In yet other aspects of the present disclosure, there is provided a method for forming a door stop for retaining a door open with magnetic force. In an embodiment, the method comprises molding at least one of a rubber material, a thermo plastic elastomer, and a thermoplastic material over an anchor screw to form a spacer body having at least part of the anchor screw extending out a proximal end and having an area of reduced cross-section closer to a distal end than the proximal end and placing a permanent magnet or a ferromagnetic material inside a bore having a continuously formed side wall defining a cavity at the distal end of the spacer body such that at least part of the permanent magnet or the ferromagnetic material protrudes from the distal end of the spacer body. The method further includes the step of incorporating a length for the spacer body so that the spacer body is sufficiently long for preventing a door handle of a door from slamming against a wall and providing a strike plate made from a permanent magnet or a ferromagnetic material for use with the spacer unit. In another embodiment, a helical spring is embedded in the spacer body. As the helical spring is preferably for preventing excessive compression, the spring is preferably an extension spring with a plurality of coils in contact with one another.

A still further aspect of the present disclosure is a method for distributing door stops for retaining doors open using magnetic force. The method comprises offering at least one spacer unit for use as a door stop inside a package, said at least one spacer unit comprising a spacer body made from at least one of a rubber material, a thermo plastic elastomer material, and a thermoplastic material molded over an anchor screw in which at least part of the anchor screw extends out a proximal end of the spacer body. The spacer body further has an area of reduced cross-section closer to a distal end than the proximal end; a continuous and seamless exterior side wall surface; and a permanent magnet or a ferromagnetic located inside a bore having a continuously formed side wall defining a cavity at the distal end of the spacer body such that at least part of the permanent magnet or the ferromagnetic material protrudes from the distal end of the spacer body. The method further comprises including at least one strike plate for use with the at least one spacer unit, said at least one strike plate configured to magnetically adhere with said permanent magnet or said ferromagnetic material protruding from the distal end of the spacer body of the at least one spacer unit; and distributing the at least one spacer unit over a commercial channel. As used herein, the term "commercial channel" is any mode or means for delivering the package to a purchaser, such as by air freight, by mail, by cargo truck, by train, by courier, etc.

The door stop assembly 100 of the present embodiment provides at least a trifecta of benefits. Among them, the door stop assembly 100 is configured to prevent door slams, retains door in an open state, and flexes to reduce vibration upon separating the magnetic force between the spacer body and the strike plate. The ability to flex may also be considered an additional benefit in that it can resist accidental contact therewith, such as from a vacuum cleaner or a person's foot without damaging the wall structure to which it is mounted.

Accordingly, aspects of the present system, apparatus, and method include a door stop assembly comprising a spacer made of a first material molded with a helical coil section of a second material and wherein at least one coil section of the helical coil section extends externally of the spacer for mounting to a mounting bracket. A further aspect of the present invention is a door stop assembly having a spacer having an exterior surface made of an elastomer material, a proximal end connected to a coil spring, and a distal end having a cavity for accommodating at least one of a metal material or a magnet. Most preferably, the spacer is unitarily formed with a distal end for accommodating at least one of a metal material or a magnet and a proximal end molded with a helical coil section in which at least a section of a coil is exposed and extends away from the spacer. The spacer may also be practiced without a magnet or without a plate for use with a magnet.

The present disclosure is further understood to include a spacer unit having dampening characteristics that easily fit into existing prior art mounting brackets thus enabling retrofitting of existing door stops with door stops of the present disclosure easily and effectively. As such, it is contemplated that a pack or package comprising a plurality of door stops having spring spacers or spacers as provided herein with dampening characteristics may be offered commercially. The packs enable a home owner, tenant, or worker to easily swap out non-dampening spring spacers with dampening spacers.

Figure 18A:
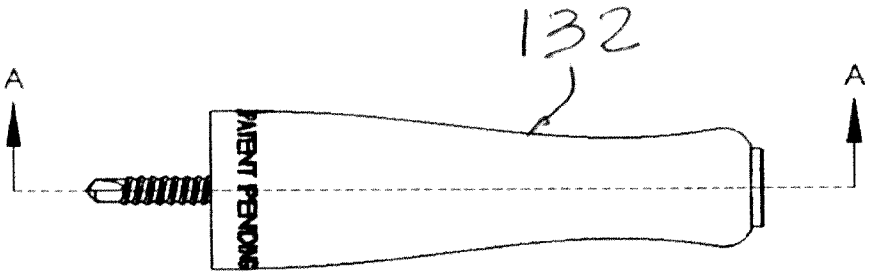
FIGS. 18A and 18B are side and cross-sectional views, respectively, of yet another door stop assembly provided in accordance with aspects of the present disclosure.
Figure 18B:
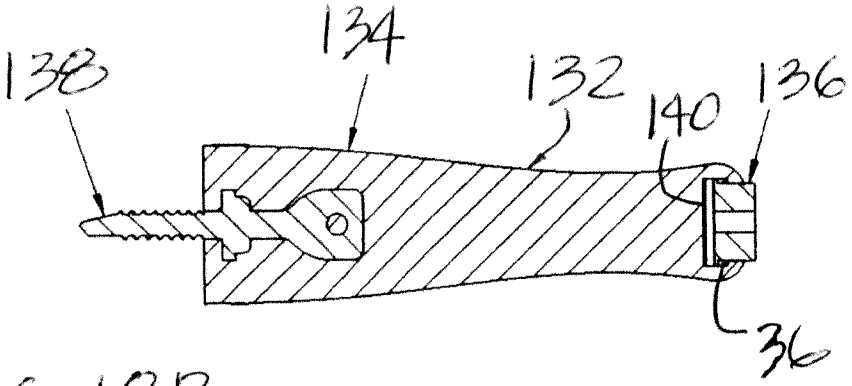

FIGS. 18A and 18B are side and cross-sectional side views, respectively, of still yet another door stop assembly 132 provided in accordance with further aspects of the present system, apparatus, and method. In the present embodiment, the magnet 136, which may be flushed, recessed, or protruded from the tip of the spacer body 134 as shown, has an enlarged flange 140 for engaging the mold material used to form the spacer body, as further discussed below. The spacer body 134 further incorporates an anchor screw 138 for fastening the assembly into a wall or surface structure. In another embodiment, the outer surface of the magnet 136 is not uniform, such as not generally cylindrical to enable molding materials to flow therein or therewith to grip the magnet.

Figure 19B:
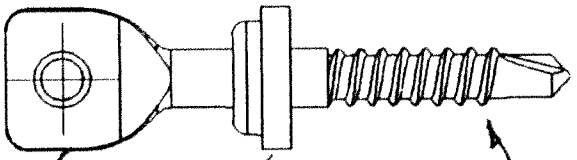
FIGS. 19A-19C are perspective and side views, respectively, of an anchor screw provided in accordance with aspects of the present disclosure.
Figure 19C:
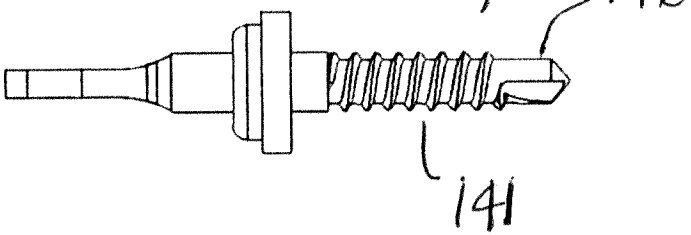
Figure 19A:
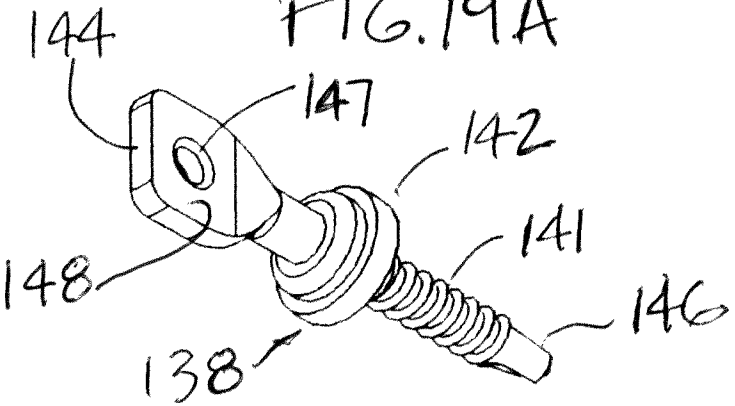

With reference to FIGS. 19A-19C in addition to FIG. 18B, the anchor screw 138 in accordance with one example of the present embodiment comprises a threaded shaft 141, a knuckle or flange 142, and a screw head 144. The threaded shaft 141 comprises a tip but may in turn incorporate a self drilling or self-tapping tip 146. The knuckle 142 may be a washer placed over the threaded shaft 141 but is preferably an integrally formed enlarged platform having an extended base surface 148 that extends outwardly of the maximum diameter of the shaft 141. The extended base surface 148 allows mold material to surround the knuckle 142, which may be referred to as a first extended surface, so as to prevent pitching and yawning of the anchor screw 138 relative to the spacer body 134. The screw head 144, which may be referred to as a second extended surface and allows mold material to form thereoever, is incorporated to prevent the anchor screw 138 from rolling relative to the spacer body 134. In one example, the screw head 144 is generally flat and has a generally square and oblong combination shape. In other embodiments, the screw head is round, oval, rectangle, or irregular in shape. Optionally, a through hole 147 is incorporated in the screw head 144 to further facilitate mold flow and adhesion. The anchor screw 138 is preferably molded from steel or other metallic material. Alternatively, the anchor screw is machined. Still alternatively, the anchor screw 138 is an assembly of several different components, such as a screw and a washer. A size 8 course thread screw has been found to be adequate.

Figure 20A:
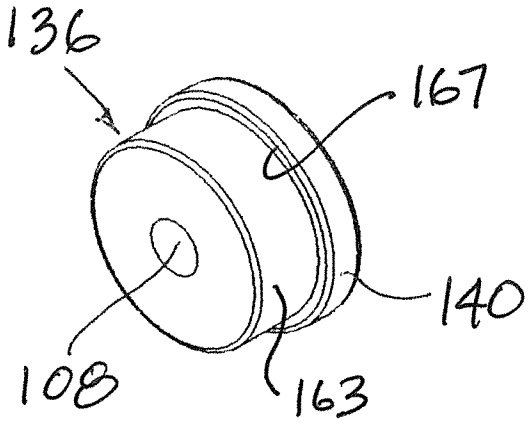
FIGS. 20A and 20B are perspective and side views, respectively, of a permanent magnet or a ferromagnetic material.
Figure 20B:
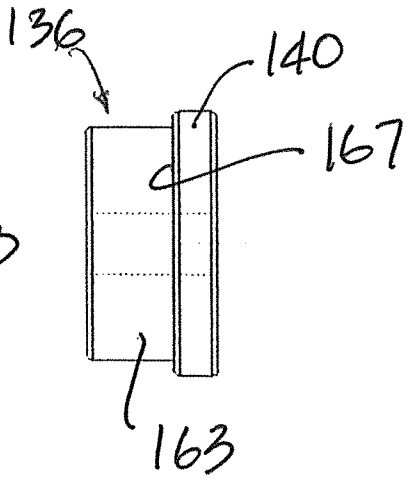

FIGS. 20A and 20B are perspective and side views, respectively, of a magnet 136 provided in accordance with an embodiment of the present disclosure. As shown, the magnet comprises a bore 108, which may be a through bore or only partially through bore, formed in a body section 163 and an enlarged base or flange 140. The body section 163 has a nominal diameter section 165 and the flange 140 has an extended portion 167 that is wider than the nominal diameter section 165. As previously discussed, the enlarged flange 140, as shown in FIG. 19B, allows mold material to flow around the lip of the flange to firmly secure the magnet within the receiving bore 36 of the spacer body. In other embodiments, the flange 140 is formed somewhere along the length of the body but not necessary at the proximal most end as shown. In yet another example, a groove or indentation instead of a flange is incorporated for mold flow and adhesion. In still other embodiments, the bore 108 may be omitted.

Figure 21:
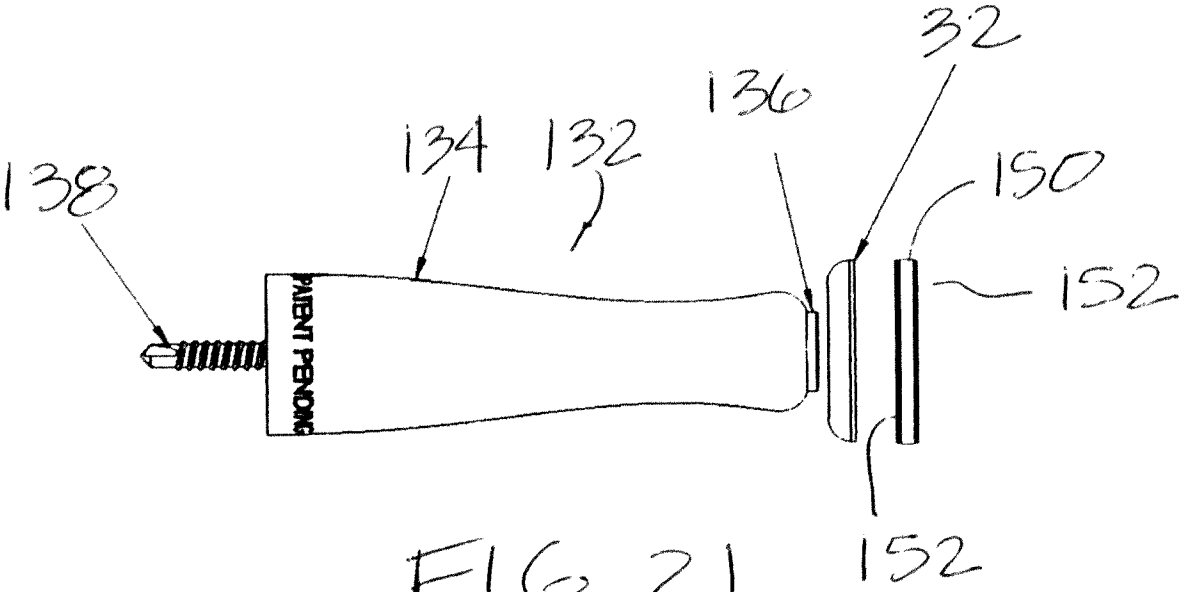
FIG. 21 is a side view of the embodiment of FIGS. 18A and 18B shown with a double-sided tape.

FIG. 21 is a side view of the door stop assembly 132 of FIGS. 18A-18B shown with a strike plate 32 and an adhesive tape 150. In the embodiment shown, the adhesive tape 150 is used instead of a plate screw 34, such as shown in FIG. 14. Alternatively, the adhesive tape 150 may be used in addition to the plate screw 34. For example, the adhesive tape 150 may be a double-sided tape having peelable layers 152 configured to temporarily hold the strike plate 32 in position. Then a plate screw 34 is used to more permanently or firmly secure the strike plate to a surface, such as to a baseboard or a door. Alternatively, strong double-sided foam tape or adhesive may be used without a plate screw 34. Double-sided tapes are available from 3M and Scotch. Thus, when a strong double-sided adhesive is used, a novel method for mounting the strike plate includes placing the strike plate in contact with the magnet of the door stop, remove the peelable protective cover from the double-sided adhesive, and swing the door so that a mounting surface, such as the surface of the door or the base plate, contacts the exposed adhesive. After the adhesive sets, the door may be swung away to separate the strike plate from the magnet.

To mount the door stop assembly 132 and strike plate 32 and to further elaborate, a pilot hole is drilled for turning the anchor screw 138 therein to secure the door stop assembly against a surface. The door is then swung so that contacts are simultaneously made between the strike plate 32, the magnet 136, and the double-sided tape 150, which has the outer peelable cover 152 removed. The door stop assembly is configured for mounting on either a door or a base board.

As understood, a feature of the present apparatus, system, and method include a door stop comprising a spacer body, a magnet located at a tip of the spacer body and an anchor screw at a base of the spacer body; and wherein the anchor screw comprises a first extended surface to prevent pitching and yawning and a second extended surface to prevent rolling of the anchor screw relative to the spacer body. In a specific example, the anchor screw is singularly formed with the first extended surface and the second extended surface. In another example, at least the first extended surface or the second extended surface is separately formed from a threaded shaft of the anchor screw.

In another feature of the present disclosure, a method is provided comprising placing a strike plate against a permanent magnet or a ferromagnetic material located on a door stop spacer body and placing double-sided adhesive tape against the strike plate. In a specific example, the door stop spacer body has an anchor screw and the anchor screw is screwed into a base board or a door and the adhesive tape, in addition to being adhered to the strike plate, is adhered to the other one of the base board or the door. In a still further example, the anchor screw comprises a first extended surface to prevent pitching and yawning and a second extended surface to prevent rolling of the anchor screw relative to the spacer body.

Although limited embodiments of the door stop assemblies and their components have been specifically described and illustrated herein, many modifications and variations will be apparent to those skilled in the art. For example, the geometry (i.e., size, shape, thickness) of the spring spacer may be different, the helical coils may be larger or smaller, and the materials selected for the pliable insert or pliable sheath may be other than as expressly described provided they dampen the vibration amplitude of the spring in accordance with the teachings of the present invention. In addition, the door stop assembly may be used without the combination magnet and strike plate. Thus, a pliable insert or a pliable sheath may be used with a prior art spring spacer to minimize vibration but not retain a door in a fixed open position. Still alternatively, a spring spacer may be continuously formed but not singularly or integrally formed, i.e., with an attachment or seam for joining two or more pieces together. In yet another alternative embodiment, the spacer unit could be insert molded with a flexible and pliable body, without helical coils. A magnet and a mounting screw could be mounted with the insert molded body. For example, the entire unit could be made from a pliable TPE material having a magnet insert molded therewith. The mounting screw could also be formed therewith to attach to a baseboard without a mounding bracket. Accordingly, it is to be understood that the door stop assemblies and their components constructed according to principles of this invention may be embodied other than as specifically described herein. The invention is also defined in the following claims.

What is claimed is:

1. A door stop assembly comprising a non-metallic spacer body, a magnet at least partially embedded at a tip of the spacer body, the spacer body made of a solid material, and an anchor screw having a portion embedded in the spacer body at a base of the spacer body; said anchor screw having a threaded shaft extending axially of the base; and wherein the portion of the anchor screw embedded in the spacer body comprises a first extended surface having the spacer body molded around two opposed axially arranged surfaces of the first extended surface to prevent pitching and yawing and a second extended surface having the spacer body molded around two opposed axially arranged surfaces of the second extended surface to prevent rolling of the anchor screw relative to the spacer body.

2. The door stop assembly of claim 1, wherein the anchor screw is singularly formed with the first extended surface and the second extended surface.

3. The door stop assembly of claim 1, wherein at least the first extended surface or the second extended surface is separately formed from the threaded shaft on the anchor screw.

4. The door stop assembly of claim 1, wherein the magnet has a nominal diameter section and an extended section that is wider than the nominal diameter section to define a gripping surface for the non-metallic spacer body to grip.

5. The door stop assembly of claim 1, wherein the second extended surface comprises a flange having a length, a width, and a depth and wherein the depth is smaller than a diameter of the threaded shaft.

6. The door stop assembly of claim 1, further comprising a metallic strike plate and a two-sided adhesive, said two-sided adhesive is attached on one side to the metallic strike plate and on another side to a baseboard, wall, or door.

7. The door stop of claim 4, wherein the magnet has a through bore or only partially through bore. The door stop of claim 1, wherein one of the two opposed axially arranged surfaces of the first extended surface is a planar surface generally orthogonal to an axis defined by the threaded shaft, and the second extended surface extends radially from the axis.

8. The door stop of claim 1, wherein one of the two opposed axially arranged surfaces of the first extended surface is a planar surface generally orthogonal to an axis defined by the threaded shaft, and the second extended surface extends radially from the axis.

9. A door stop assembly comprising a non-metallic spacer body made of a solid material holding a magnet at a tip of the spacer body such that the magnet is exposed at the tip and an anchor screw at a base of the spacer body; said anchor screw having a threaded shaft extending axially of the base;

a metallic strike plate for striking against the magnet; and wherein a portion of the anchor screw embedded in the spacer body comprises a first extended surface having the spacer body molded around two opposed axially arranged surfaces of the first extended surface to prevent pitching and yawning of the anchor screw relative to the spacer body and a second extended surface having the spacer body molded around two opposed axially arranged surfaces of the second extended surface to prevent rolling of the anchor screw relative to the spacer body;

wherein one of the two opposed axially arranged surfaces of the first extended surface is a planar surface generally orthogonal to an axis defined by the threaded shaft, and the second extended surface extends radially from the axis.

10. The door stop assembly of claim 9, further comprising double-sided tape adhered to a surface of the strike plate.

11. The door stop assembly of claim 9, wherein the magnet has a nominal diameter section and an extended section that is wider than the nominal diameter section to define a gripping surface for the non-metallic spacer body to grip.

12. The door stop assembly of claim 10, further comprising a self-tapping tip located at an end of the threaded shaft.

13. The door stop assembly of claim 11, further comprising a bore formed completely through or partially through the magnet.

* * * * *